US011148155B2

(12) United States Patent
Chen

(10) Patent No.: US 11,148,155 B2
(45) Date of Patent: Oct. 19, 2021

(54) SPRAY DEVICE

(71) Applicant: San-Ching Chen, New Taipei (TW)

(72) Inventor: San-Ching Chen, New Taipei (TW)

( * ) Notice: Subject to any disclaimer, the term of this patent is extended or adjusted under 35 U.S.C. 154(b) by 210 days.

(21) Appl. No.: 16/515,381

(22) Filed: Jul. 18, 2019

(65) Prior Publication Data

US 2019/0344296 A1 Nov. 14, 2019

Related U.S. Application Data

(63) Continuation-in-part of application No. 15/854,795, filed on Dec. 27, 2017, now abandoned, which is a continuation-in-part of application No. 14/578,655, filed on Dec. 22, 2014, now abandoned.

(51) Int. Cl.
*B05B 11/00* (2006.01)
*B05B 11/06* (2006.01)
*B05B 15/40* (2018.01)

(52) U.S. Cl.
CPC ..... *B05B 11/061* (2013.01); *B05B 15/40* (2018.02)

(58) Field of Classification Search
CPC ..... B05B 9/0403
USPC ..... 239/329, 330
See application file for complete search history.

(56) References Cited

U.S. PATENT DOCUMENTS 2,591,858 A 4/1952 Moore
3,282,227 A 11/1966 Nielsen
3,317,141 A 5/1967 Mann
3,680,789 A 8/1972 Wagner
3,877,842 A * 4/1975 Greene ..... F04B 39/06 417/312
3,930,615 A 1/1976 Farnsteiner
3,940,065 A 2/1976 Ware et al.
4,163,523 A 8/1979 Vincent
4,229,306 A * 10/1980 Hein ..... B01D 29/012 210/446
4,301,971 A * 11/1981 Cornelius ..... B05B 7/2437 222/401
4,378,201 A * 3/1983 Quarve ..... F04B 43/067 417/388
4,397,422 A * 8/1983 Gwyn ..... B05B 7/30 222/136
4,508,271 A 4/1985 Gress
4,546,922 A 10/1985 Thometz
4,551,037 A 11/1985 Kille et al.
(Continued)

*Primary Examiner* — Viet Le
(74) *Attorney, Agent, or Firm* — Muncy, Geissler, Olds & Lowe, P.C.

(57) ABSTRACT

A spray device comprises a diaphragm pump, a spray gun and a hose. The diaphragm pump comprises an air outlet to supply air flow, a casing and a pump assembly disposed in the casing. The spray gun comprises a housing and a Venturi tube arranged entirely inside the housing. The housing has an air inlet to receive the air flow supplied from the diaphragm pump and guide the air flow into the Venturi tube. The spray gun comprises a paint receptacle that receives and holds therein a paint material that is supplied into the spray gun and atomized to form paint droplets and entrain the air flow received from the diaphragm pump to allow the paint droplets to be sprayed onto a workpiece. The hose has two ends respectively coupled to the air outlet of the diaphragm pump and the air inlet of the spray gun.

17 Claims, 5 Drawing Sheets

(56) References Cited

U.S. PATENT DOCUMENTS 4,708,088 A * 11/1987 Purvis ..... B05B 9/0403 118/300
4,753,390 A 6/1988 Henderson
4,948,042 A * 8/1990 Tench ..... B05B 7/2408 239/113
5,058,807 A * 10/1991 Smith ..... B05B 7/2486 239/302
5,086,978 A 2/1992 Fertig
5,180,104 A * 1/1993 Mellette ..... B05B 7/0081 239/11
5,228,622 A 7/1993 Murphy et al.
5,358,385 A * 10/1994 Wang ..... F04B 45/043 417/44.8
5,713,519 A * 2/1998 Sandison ..... B05B 7/0846 239/8
6,257,842 B1 * 7/2001 Kawasaki ..... F04B 35/045 181/229
6,527,201 B2 3/2003 Lieber
6,540,119 B1 * 4/2003 Bensussan ..... A45F 5/02 222/192
7,284,737 B2 * 10/2007 Kane ..... A47G 23/0225 248/226.11
7,407,117 B2 8/2008 Dodd
7,726,954 B2 6/2010 Ben-Yosef et al.
8,302,884 B1 11/2012 Barrera et al.
8,360,287 B2 1/2013 Ciavarella et al.
8,501,282 B2 * 8/2013 Staunton ..... B05B 7/2481 427/426
8,651,397 B2 2/2014 Gaddis et al.
2001/0048882 A1 * 12/2001 Layman ..... F04B 43/025 417/395
2002/0028103 A1 3/2002 Frank et al.
2005/0199667 A1 * 9/2005 Cappellino ..... A47G 23/0225 224/411
2006/0040044 A1 2/2006 Robens et al.
2006/0102745 A1 5/2006 Dexter
2006/0289679 A1 12/2006 Johnson et al.
2007/0025863 A1 2/2007 Liedtke et al.
2007/0134050 A1 6/2007 Bruggeman et al.
2008/0272150 A1 * 11/2008 Hahn ..... B05B 7/0081 222/145.1
2012/0091229 A1 4/2012 Laidler et al.
2014/0023533 A1 * 1/2014 Ishii ..... F04B 43/026 417/413.1

* cited by examiner

SPRAY DEVICE

This application is a Continuation-in-Part of application Ser. No. 15/854,795, filed on Dec. 27, 2017, which is a Continuation-in-Part of application Ser. No. 14/578,655, filed on Dec. 22, 2014, the entire contents of all of which are hereby incorporated by reference.

BACKGROUND OF THE INVENTION

Field of the Invention

Description of the Prior Art

Spray devices, such as painting sprayers, operated with pressurized air supplied from an air compressor are known. The air compressor used with such a spray device is a piston-type air compressor that is operated at a power of 3 Hp (2,200 W), which generates a very high level of noise that is uncomfortable to the users. Such an air compressor supplies a pressurized airflow at a pressure level higher than 30-50 psi. It is common in paint spraying to use a hose having a diameter not greater than 0.6 cm to connect to air compressor and a paint sprayer. This provides an extremely high speed of paint jet, which when hitting a wall, rebound from the wall and spread into the surrounding air, causing undesired contamination and harm to human body for a user standing nearby. This also causes a loss of paint.

U.S. Pat. Nos. 4,397,422 and 5,713,519 both disclose a spray gun with a Venturi tube for entraining colorants, and the Venturi tube is exposed out of the spray gun, which is easy to be damaged by external forces. Furthermore, containers for receiving colorants are only connected to the Venturi tube by separate tubes, which has poor connection stability and the spray gun is inconvenient to be operated.

U.S. Pat. No. 4,301,971 discloses a spray gun having a diaphragm-type compressor disposed therewithin. However, the spray gun has a complicated structure and the diaphragm-type compressor cannot be applied to existing spray guns.

Apparently, improvements are necessary for such a known paint spraying system in order to reduce the power consumed and noise generated during the operation of the air compressor and also to reduce unnecessary contamination and harm to the surroundings, as well as undesired loss of paint.

SUMMARY OF THE INVENTION

The main object of the present invention is to provide a low-pressure and low-noise spray device that overcomes the above-discussed drawbacks of the prior art.

To achieve the above and other objects, the present invention provides a spray device, which comprises:

a diaphragm pump, comprising an air outlet to supply the air flow, a casing and a pump assembly disposed in the casing, the casing comprising a receiving room disposed on an upper side of the casing and a top cover covered on the receiving room, a filter being received in the receiving room; a gap being formed between the top cover and a periphery wall of the receiving room, a bottom wall of the receiving room having at least one through hole communicated with an interior of the casing, a plurality of fins extending on an outer surface of the casing, the plurality of fins being spaced apart from one another and defining a plurality of channels communicated with an interior of the receiving room, the top cover being saddled on the plurality of fins;

a spray gun that comprises a housing and a Venturi tube arranged entirely inside the housing, the housing having an air inlet to receive the air flow supplied from the diaphragm pump and guide the air flow into the Venturi tube, the air inlet being communicated with the Venturi tube in the housing, the air inlet extending out of the housing, the spray gun further comprising a paint receptacle that receives and holds therein a paint material that is supplied into the spray gun and atomized to form paint droplets and entrain the air flow received from the diaphragm pump to allow the paint droplets to be sprayed onto a workpiece; and a hose having two ends respectively coupled to the air outlet of the diaphragm pump and the air inlet of the spray gun for conducting the air flow from the diaphragm pump to the spray gun.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
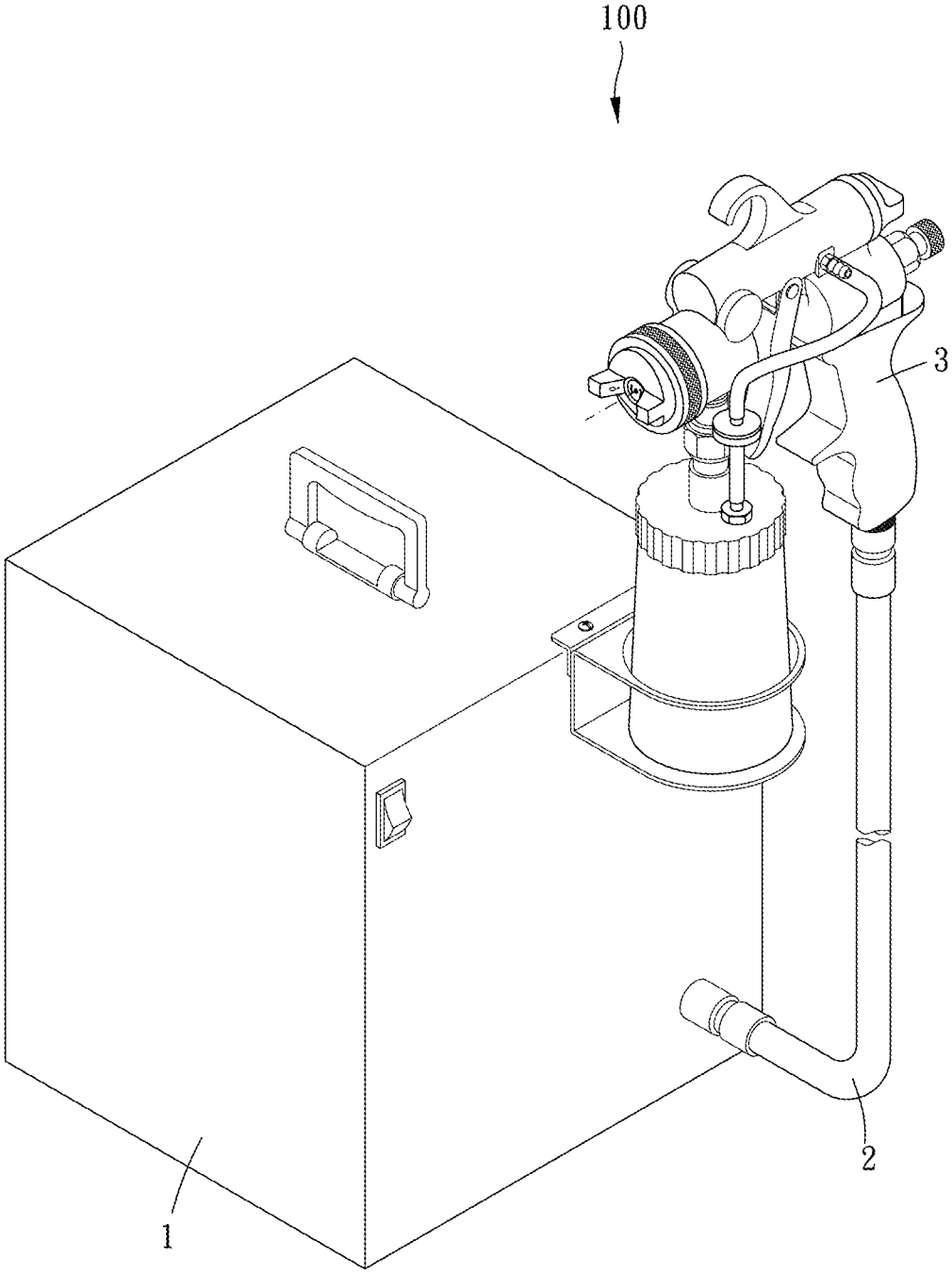
FIG. 1 is a perspective view showing a spray device according to the present invention.
Figure 2:
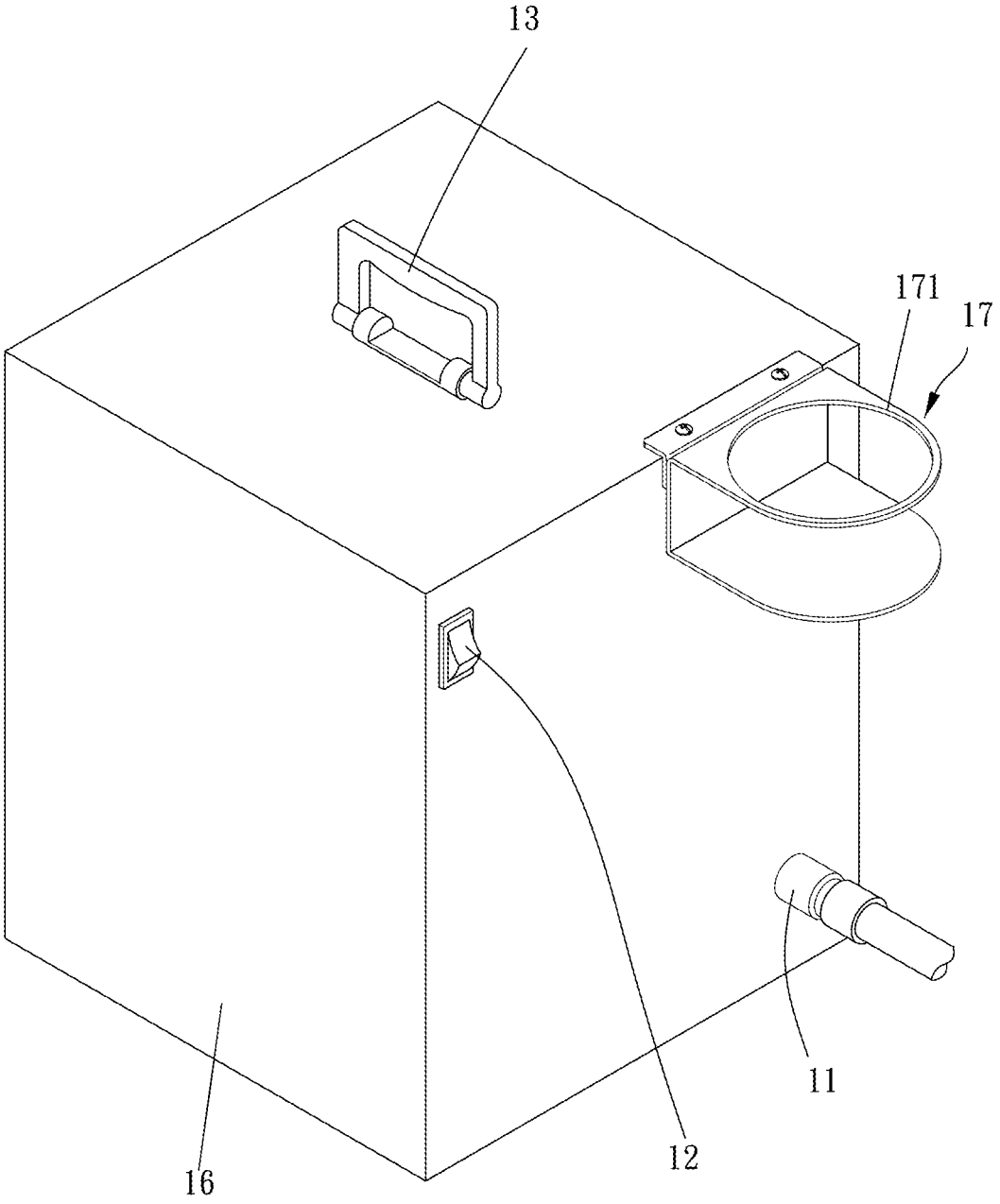
FIG. 2 is a partial stereogram of a diaphragm pump of the present invention.
Figure 3:
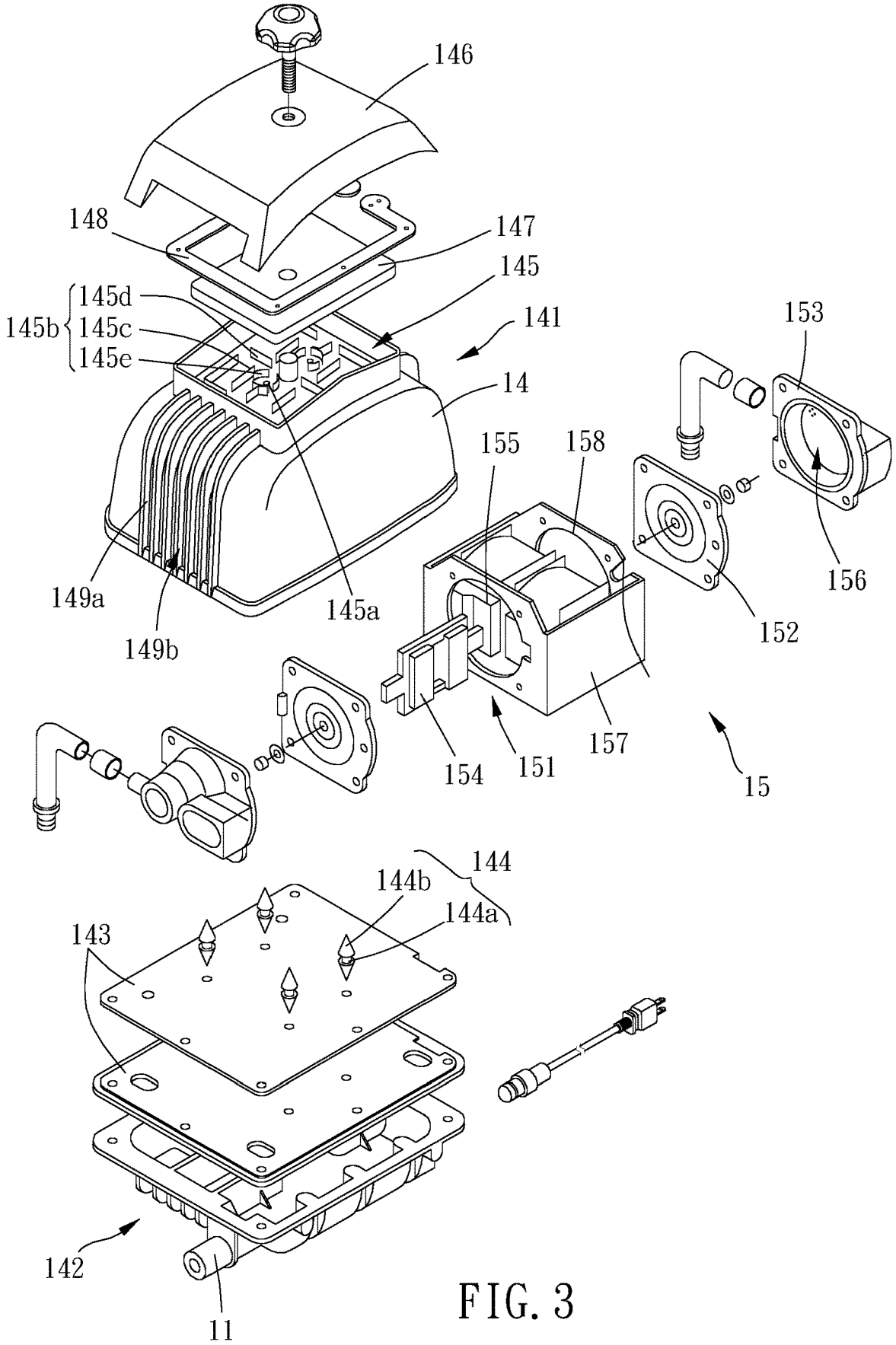
FIG. 3 is a partial breakdown drawing of the diaphragm pump of the present invention.
Figure 5:
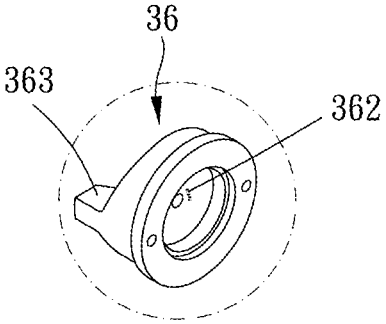
FIG. 5 is a stereogram of an air cap in FIG. 4 as viewed from another side.
Figure 4:
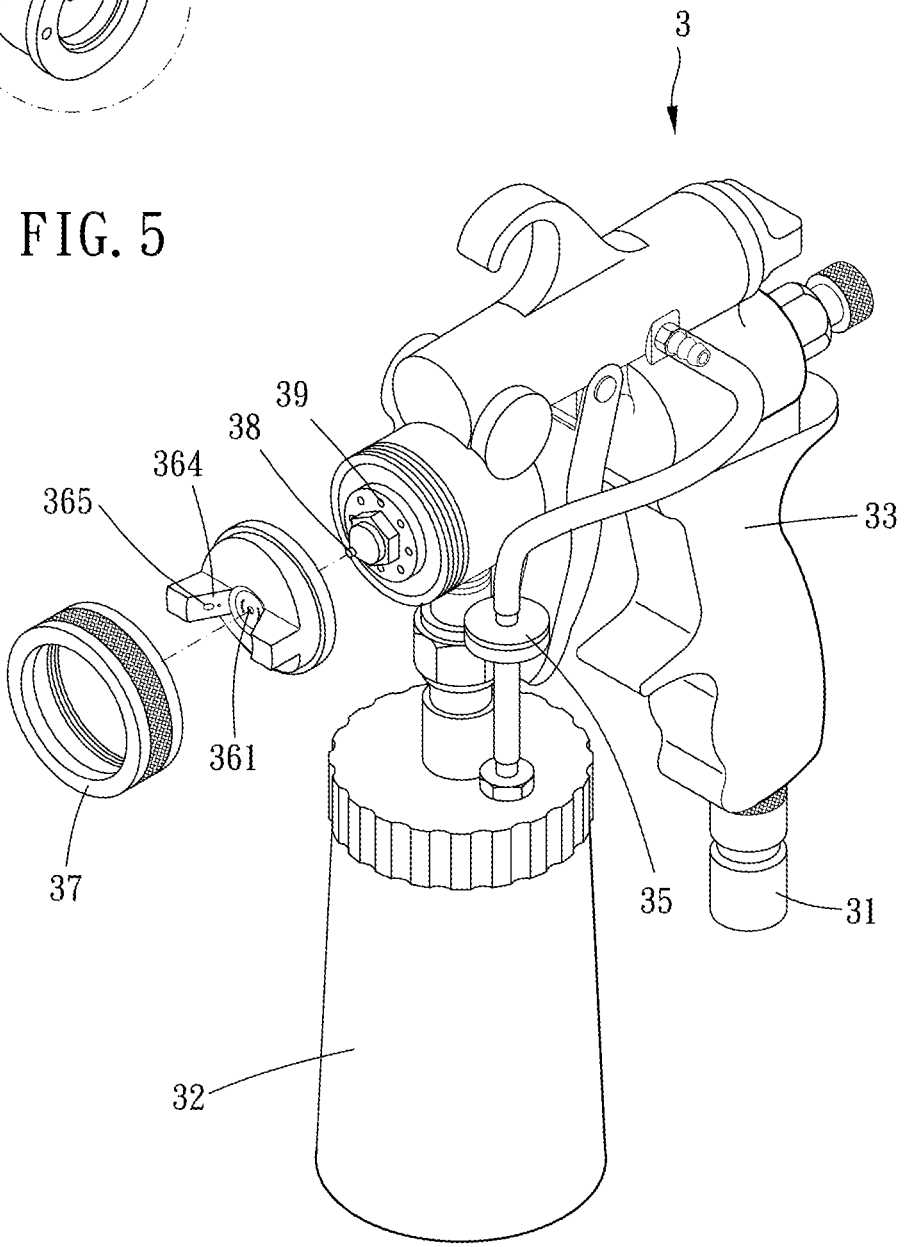
FIG. 4 is a partial breakdown drawing of a spray gun of the present invention.
Figure 6:
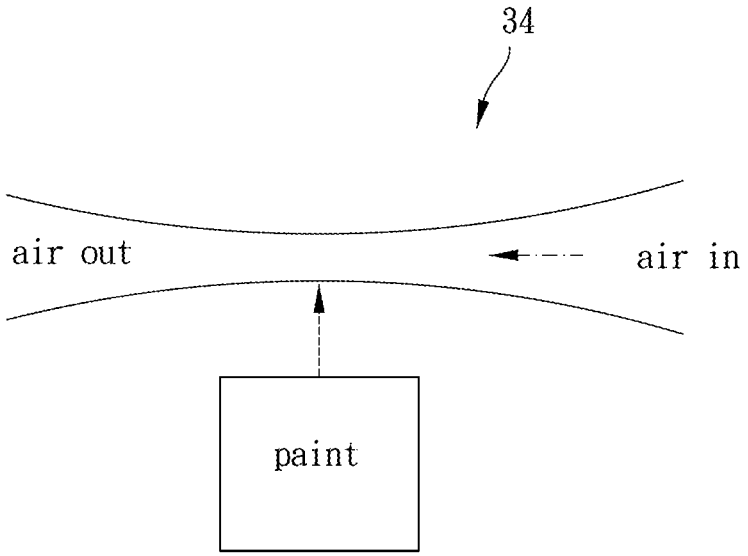
FIG. 6 is a schematic view illustrating a Venturi tube used in the present invention for creating a low-pressure airflow with which paint droplets entrain.

Referring to FIGS. 1 to 6, the present invention provides a low-pressure and low-noise spray device, generally designated at 100, which comprises an air pump 1, which is preferably a low-voltage electromagnetic diaphragm pump, having an air outlet 11. A power switch 12 is provided on the air pump 1 to selectively turn on/off the pump 1. Preferably, a handle 13 is also provided and mounted to the pump 1 for hand gripping and carrying.

The spray device 100 also comprises a spray gun 3, which comprises a housing 33 having an air inlet 31 that receives a supply of air from the pump 1. A paint receptacle 32 receives and holds therein a paint material and is connected to the spray gun 3 to supply paint to the spray gun 3. The paint receptacle 32 is removable from the spray gun 3 for replacement or replenishment of the paint material. Preferably, the spray gun 3 comprises a Venturi tube 34 arranged entirely inside the housing 33. The air inlet 31 of the housing 33 guides the air flow into the Venturi tube 34, and the air inlet 31 is communicated with the Venturi tube 34 in the housing 33. The air inlet 31 extends out of the housing 33. The Venturi tube 34 includes a length of tube having varying diameter and including an inlet, which is marked as "air in" in FIG. 5. The Venturi tube 34 has a narrowest section between the inlet and an opposite outlet (marked "air out" in FIG. 5) and connected with the paint receptacle 32 in order to allow paint to be supplied from the paint receptacle 32 into the air flow passing through the Venturi tube 34 so as to allow paint droplets to entrain the air flow and sprayed out through the outlet of the Venturi tube 34.

The spray gun 3 further comprises a check valve 35 which is communicated between the air inlet 31 and the paint receptacle 32, and the check valve 35 is configured to allow part of the air flow to unidirectionally flow into the paint receptacle 32 so that the paint material in the paint receptacle 32 is easier to be entrained into the Venturi tube 34.

The spray gun 3 further comprises an air cap 36 and a mounting ring 37 which adjustably assembles the air cap 36 to a front of the spray gun 3. The air cap 36 includes a central hole 361 and a plurality of perforations 362 disposed around the central hole 361. The front of the spray gun 3 includes a paint nozzle 38 inserted into the central hole 361 and a plurality of air outlets 39 communicated with the plurality of perforations 362, wherein the plurality of perforations 362 are smaller than the central hole 361 and the plurality of air outlets 39. Therefore, the air flow from the pump 1 can flow out from the plurality of perforations 362 to disturb the paint droplets from the paint nozzle 38 so as to increase uniformity of spraying. In this embodiment, the mounting ring 37 is sleeved on the air cap 36 and screwed to the front of the spray gun 3 so that a spraying pattern is adjustable by rotating the air cap 36. The air cap 36 further includes two projections 363 disposed on two opposite sides of the central hole 361. The two projections 363 protrude forwardly and have respective arcuate concaves 364 facing to each other, and each of the respective arcuate concaves 364 has at least one aperture 365 which is communicated with the plurality of air outlets 39 of the spray gun 3 so as to sufficiently disperse the paint droplets and restrict a spraying direction of the paint droplets. Preferably, the plurality of perforations 362 are arranged between the central hole 361 and the two projections 363 so that the paint droplets are centralized in a direction transverse to the two projections 363.

A hose or tube 2 is provided to connect the pump 1 to the spray gun 3. The hose 2 has two ends respectively connected to the air outlet 11 of the pump 1 and the air inlet 31 of the spray gun 3. Preferably, the connection between the hose 2 and the air outlet 11 of the pump 1 and the air inlet 31 of the spray gun 3 is achieved with screwing or quick connectors. It is particularly noted here that in order to maintain a low pressure of the air supplied through the hose 2 and the spray gun 3 and also to prevent undesired loss of pressure, the hose 2 is configured with a diameter that is not less than 1.5 cm. Compared to the 0.6 cm diameter tube used in the known spray system, the 1.5 cm diameter tube allows for a sufficiently large airflow of a low pressure to be supplied from the air pump 1 to the spray gun 3.

The air pump 1 is preferably a low wattage pump operated with a low AC power or a portable DC battery. An example of the air pump 1 is a low-pressure electromagnetic diaphragm pump, which generates a large volume of air flow but at a much lower level of noise compared to the conventionally used air compressor. The diaphragm pump of this invention may generate an air flow of 200-250 L/min and this flow rate is large enough for such a low pressure to atomize paint in the spray gun 3. The noise generated with the air pump 1 of this invention, which is a diaphragm pump, is not more than 55 dB(A), while the conventional air compressor generally has a noise over 100 dB(A). Power consumption of the conventional air compressor, which is generally operated with a reciprocal movement of a piston, is around 2,200 W, while that of the diaphragm pump used in this invention is around 250 W. This is a huge difference.

The diaphragm pump comprises a casing 14 and a pump assembly 15 disposed in the casing 14. The pump assembly 15 comprises an electromagnetic mechanism 151, two diaphragms 152 and two side covers 153 respectively sealingly covered on the two diaphragms 152. The electromagnetic mechanism 151 comprises a magnetic member 154 and two electromagnetic bodies 155 disposed at two opposite sides of the magnetic member 154, the two diaphragms 152 are respectively connected with two opposite ends of the magnetic member 154, and a compression space 156 is defined between each of the two side covers 153 and one of the two diaphragms 152. When an electromagnetic induction is generated between the magnetic member 154 and the two electromagnetic bodies 155, the magnetic member 154 is moved between the two electromagnetic bodies 155 and drives the two diaphragms 152 to compress air in respective one of said compression spaces 156.

The pump assembly 15 further comprises a frame 157, and two opposite sidewalls of the frame 157 have respective openings 158 corresponding to each other. The electromagnetic mechanism 151 is disposed within the frame 157, and each of the two diaphragms 152 covers one of the respective openings 158 and is detachably assembled to the frame 157. Therefore, the diaphragm pump is easy to be assembled, maintained and replaced.

The casing 14 comprises an upper portion 141 and a lower portion 142 which are partitioned from each other. The lower portion 142 has the air outlet 11 to supply the air flow, the pump assembly 15 is disposed in the upper portion 141, and the respective one of said compression spaces 156 are communicated with the lower portion 142. The casing 14 further comprises at least one base plate 143 detachably disposed between the upper portion 141 and the lower portion 142; the respective one of said compression spaces 156 are communicated with the lower portion 142 by respective tubes inserted into the at least one base plate 143 so as to transfer compressed air. In this embodiment, the casing 14 comprises two of said base plates 143 which are connected with each other by at least one connector 144. Each of the at least one connector 144 includes a neck portion **144*a* and two cone portions 144*b* respectively disposed at two opposite sides of neck portion 144*a* and tapered in a direction opposite to each other for easy insertion. The at least one connector 144 is inserted into the two of said base plates 143 and restricts the two of said base plates 143 at the neck portion 144*a* so as to avoid relative movement of the two of said base plates 143. The at least one connector 144** may be made from rubber, plastic or other flexible materials for easy assembling.

The casing 14 further comprises a receiving room 145 disposed on an upper side of the casing 14 and a top cover 146 covered on the receiving room 145, and a filter 147 is received in the receiving room 145 so as to prevent dust from entering the casing 14. A gap is formed between the top cover 146 and a periphery wall of the receiving room 145 and a bottom wall of the receiving room 145 has at least one through hole 145*a* communicated with an interior of the casing 14, which allows air to flow into the casing 14. The bottom wall of the receiving room 145 further has a plurality of ribs 145*b*, and the filter 147 is disposed on the plurality of ribs 145*b* so as to prevent the filter 147 from directly covering the at least one through hole 145*a* and increase flow of air. A retainer 148 is disposed between the top cover 146 and the filter 147 and abuttable against the periphery wall of the receiving room 145 to restrict a position of the filter 147. The plurality of ribs 145*b* includes a plurality of first straight ribs 145*c*, a plurality of second straight ribs 145*d* and a plurality of arced ribs 145*e*, the plurality of first straight ribs 145*c* extend in a direction perpendicular to a direction in which the plurality of second straight ribs 145*d* extend, and the plurality of arced ribs 145*e* are located between the plurality of ribs 145*b* and disposed around the at least one through hole 145*a*.

Preferably, the casing 14 further comprises a plurality of fins 149*a* extending on an outer surface of the casing 14. The plurality of fins 149*a* are spaced apart from one another and define a plurality of channels 149*b* communicated with an interior of the receiving room 145, and the top cover 146 is saddled on the plurality of fins so as to dissipate heat and guide the air to flow into the receiving room 145. In this embodiment, the plurality of fins 149*a* extend from the periphery wall of the receiving room 145 to the lower portion 142 for preferable guiding effect.

In this embodiment, the air pump 1 further comprises an outer case 16 and a holder 17 detachably disposed on the outer case 16, and the holder 17 has an opening 171 to receive the paint receptacle 32, which is convenient for storage. The casing 14 is received in the outer case 16 and the power switch 12 and the handle 13 are disposed on the outer case 16.

A lot of air is pumped through the hose 2, which has a large diameter, as large as 1.5 cm, at a low pressure to the spray gun, which is also operated at such a low pressure, rather than the 30-50 psi high pressure sprayers that are conventionally used, so that the airflow induced through the spray gun 3 effectively atomizes paint by drawing paint droplets into the airflow for eventually coating on a wall. The large volume of air supplied from the diaphragm pump 1 allows the paint to entrain the airflow in a large amount for painting in a quick and efficient way. The low pressure of air used in the present invention, which is no more than about 2-3 psi, may effectively carry the paint droplets onto the wall in a moderate manner and thus, rebounding of paint droplets from the wall due to excessively impacting force of the paint droplets against the wall can be eliminated. The paint can be completely attached to the wall or any article to which the paint is sprayed. This helps reduce the loss of paint. The present invention can reduce the consumption and waste of power and noise pollution, and can reduce loss of paint or coating.

Hoses having a diameter of 1.5 cm often have a relatively thin tubular wall. This makes it is not possible for the 1.5 cm diameter hose to bear a pressure as high as 30-50 psi generated in the conventionally used air compressor. Although thickening tubular wall of the tube can be made for bearing a high pressure, such a thickened tubular wall makes the tube stiff. Stiff tube or hose is undesired for it interferes with a user's operation and moving of the spray gun 3 around a working site. Considering this, it is proposed in this invention that a hose or tube having a diameter of 1.5 cm but not with an increased tubular wall be used for working with a low air pressure of 2-3 psi generated and supplied with a diaphragm pump to allow for a supply of sufficient amount of paint and prevent paint droplets from rebounding from the wall surface due to excessively impacting force. It is noted that the paint droplets, when sprayed with an air pressure of 30 psi, rebound at a large amount for a distance of around 50 cm, while for this invention, the 2-3 psi low pressure causes only a minor amount of paint droplets rebounding from the wall for a much shorter distance of around 5 cm.

In addition, such a large diameter of 1.5 cm as adopted for the hose 2 is also advantageous in preventing excessive pressure drop due to friction with the inside surface of the hose 2. A small diameter hose, such as those used conventionally, which is 0.6 cm, would create a large frictional force on the inside surface of the hose. And, this would result in an addition loss of air pressure, and also energy.

As noted above, although the conventional air compressor, which is generally based on reciprocal movement of a piston, may provide an air pressure of 2 or 3 psi by including a regulator, the operation of such a conventional air compressor is noisy; and in addition, such a low pressure is not applicable to the conventional spray gun that is commonly used with an air compressor for such a conventional spray gun is operated with a high pressure and does not atomize paint liquid if the air pressure supplied thereto is not high enough.

The piston type air compressor, although supplying a high pressure, may not provide a sufficient large volume of airflow for atomization of paint in working with the spray gun of this invention. The piston type air compressor may be expanded in size to increase the output amount of airflow, yet this increases the operation noise, making it not a reasonable solution.

To operate a spray gun with a low pressure of 2-3 psi in a relatively silent condition, the conventionally used air compressor that generates a high level of noise and the conventionally used atomizer spray gun that is operated at a high pressure of at least 30 psi must be replaced with the air pump and spray gun of this invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A spray device, comprising:

a diaphragm pump, comprising an air outlet to supply air flow, a casing and a pump assembly disposed in the casing, the casing comprising a receiving room disposed on an upper side of the casing and a top cover covered on the receiving room, a filter being received in the receiving room; a gap being formed between the top cover and a periphery wall of the receiving room, a bottom wall of the receiving room having at least one through hole communicated with an interior of the casing, a plurality of fins extending on an outer surface of the casing, the plurality of fins being spaced apart from one another and defining a plurality of channels communicated with an interior of the receiving room, the top cover being saddled on the plurality of fins;

a spray gun that comprises a housing and a Venturi tube arranged entirely inside the housing, the housing having an air inlet to receive the air flow supplied from the diaphragm pump and guide the air flow into the Venturi tube, the air inlet being communicated with the Venturi tube in the housing, the air inlet extending out of the housing, the spray gun further comprising a paint receptacle that receives and holds therein a paint material that is supplied into the spray gun and atomized to form paint droplets and entrain the air flow received from the diaphragm pump to allow the paint droplets to be sprayed onto a workpiece; and a hose having two ends respectively coupled to the air outlet of the diaphragm pump and the air inlet of the spray gun for conducting the air flow from the diaphragm pump to the spray gun, wherein the bottom wall of the receiving room further has a plurality of ribs, the filter is disposed on the plurality of ribs, the plurality of ribs includes a plurality of first straight ribs, a plurality of second straight ribs and a plurality of arced ribs, the plurality of first straight ribs extend in a direction perpendicular to a direction in which the plurality of second straight ribs extend, and the plurality of arced ribs are located between the plurality of ribs and disposed around the at least one through hole, and wherein the spray gun further comprises an air cap and a mounting ring which adjustably assembles the air cap to a front of the spray gun, the air cap includes a central hole and a plurality of perforations disposed around the central hole, the front of the spray gun includes a paint nozzle inserted into the central hole and a plurality of air outlets communicated with the plurality of perforations, the plurality of perforations are smaller than the central hole and the plurality of air outlets.

2. The spray device of claim 1, wherein the diaphragm pump comprises a power switch for turning on/off the diaphragm pump.

3. The spray device of claim 1, wherein the diaphragm pump comprises a handle for hand gripping and carrying.

4. The spray device of claim 1, wherein the diaphragm pump further comprises an outer case and a holder disposed on the outer case, and the holder has an opening to receive the paint receptacle.

5. The spray device of claim 1, wherein the coupling between the ends of the hose and the air inlet of the spray gun is achieved with screwing or a quick connector.

6. The spray device of claim 1, wherein the coupling between the ends of the hose and the air outlet of the diaphragm pump is achieved with screwing or a quick connector.

7. The spray device of claim 1, wherein the diaphragm pump is operated at noise level of 55 dB with a power consumption of 250 W to generate the air flow of 200-250 L/min at an air pressure of 2-3 psi.

8. The spray device of claim 7, wherein the hose has a diameter of 1.5 cm.

9. The spray device of claim 1, wherein the pump assembly comprises an electromagnetic mechanism, two diaphragms and two side covers respectively sealingly covered on the two diaphragms, the electromagnetic mechanism comprises a magnetic member and two electromagnetic bodies disposed at two opposite sides of the magnetic member, the two diaphragms are respectively connected with two opposite ends of the magnetic member, and a compression space is defined between each of the two side covers and one of the two diaphragms.

10. The spray device of claim 9, wherein the pump assembly further comprises a frame, two opposite sidewalls of the frame have respective openings corresponding to each other, the electromagnetic mechanism is disposed within the frame, and each of the two diaphragms covers one of the respective openings and is assembled to the frame.

11. The spray device of claim 9, wherein the casing comprises an upper portion and a lower portion which are partitioned from each other, the lower portion has the air outlet to supply the air flow, the pump assembly is disposed in the upper portion, and respective one of said compression spaces are communicated with the lower portion.

12. The spray device of claim 11, wherein the casing further comprises at least one base plate detachably disposed between the upper portion and the lower portion.

13. The spray device of claim 12, wherein the diaphragm pump further comprises an outer case and a holder detachably disposed on the outer case, and the holder has an opening to receive the paint receptacle; the outer case comprises a power switch for turning on/off the diaphragm pump and a handle for hand gripping and carrying; the coupling between the ends of the hose and the air inlet of the spray gun is achieved with screwing or a quick connector; the coupling between the ends of the hose and the air outlet of the diaphragm pump is achieved with screwing or a quick connector; the diaphragm pump is operated at noise level of 55 dB with a power consumption of 250 W to generate the air flow of 200-250 L/min at an air pressure of 2-3 psi; the hose has a diameter of 1.5 cm; the casing comprises two of said base plates which are connected with each other by at least one connector, each of the at least one connector includes a neck portion and two cone portions respectively disposed at two opposite sides of neck portion and tapered in a direction opposite to each other, and the at least one connector is inserted into the two of said base plates and restricts the two of said base plates at the neck portion; the pump assembly further comprises a frame, two opposite sidewalls of the frame have respective openings corresponding to each other, the electromagnetic mechanism is disposed within the frame, and each of the two diaphragms covers one of the respective openings and is detachably assembled to the frame; a retainer is disposed between the top cover and the filter and abuttable against the periphery wall of the receiving room to restrict a position of the filter; the plurality of fins extend from the periphery wall of the receiving room to the lower portion; the spray gun further comprises a check valve which is communicated between the air inlet and the paint receptacle, and the check valve is configured to allow part of the air flow to unidirectionally flow into the paint receptacle; the air cap further includes two projections disposed on two opposite sides of the central hole, the two projections protrude forwardly and have respective arcuate concaves facing to each other, and each of the respective arcuate concaves has at least one aperture which is communicated with the plurality of air outlets of the spray gun; the plurality of perforations are arranged between the central hole and the two projections.

14. The spray device of claim 1, wherein a retainer is disposed between the top cover and the filter and abuttable against the periphery wall of the receiving room to restrict a position of the filter.

15. The spray device of claim 1, wherein the spray gun further comprises a check valve which is communicated between the air inlet and the paint receptacle, and the check valve is configured to allow part of the air flow to unidirectionally flow into the paint receptacle.

16. The spray device of claim 1, wherein the air cap further includes two projections disposed on two opposite sides of the central hole, the two projections protrude forwardly and have respective arcuate concaves facing to each other, and each of the respective arcuate concaves has at least one aperture which is communicated with the plurality of air outlets of the spray gun.

17. The spray device of claim 16, wherein the plurality of perforations are arranged between the central hole and the two projections.

* * * * *